United States Patent [19]

Ream et al.

[11] Patent Number: 4,657,112

[45] Date of Patent: Apr. 14, 1987

[54] MAST CONSTRUCTION FOR PEDESTAL SCAFFOLD

[75] Inventors: Michael D. Ream, Lafayette; Gerald L. Claxton, Fresno, both of Calif.

[73] Assignee: Up-right, Inc., Berkeley, Calif.

[21] Appl. No.: 856,050

[22] Filed: Apr. 25, 1986

[51] Int. Cl.[4] ..... E04G 1/22

[52] U.S. Cl. ..... 182/63; 182/141; 182/127; 52/118

[58] Field of Search ..... 182/63, 62.5, 141, 148, 182/127; 52/118, 121, 111

[56] References Cited

U.S. PATENT DOCUMENTS

| | | | |
|---|---|---|---|
| 2,948,363 | 8/1960 | Hopfeld | 182/141 |
| 2,966,956 | 1/1961 | Campbell | 182/63 |
| 3,509,965 | 5/1970 | Mitchell | 182/62.5 |
| 3,931,698 | 1/1976 | Ebersold | 52/118 |
| 4,003,168 | 1/1977 | Brady | 52/118 |
| 4,004,695 | 1/1977 | Hockensmith | 52/118 |
| 4,088,200 | 5/1978 | Cowley | 182/63 |
| 4,112,649 | 9/1978 | Fritsch | 52/118 |
| 4,168,008 | 9/1979 | Granryd | 52/118 |
| 4,171,598 | 10/1979 | Holmes | 52/118 |
| 4,185,426 | 1/1980 | Prescott | 52/118 |
| 4,258,825 | 3/1981 | Collins | 182/14 |
| 4,337,601 | 7/1982 | Vaerk | 52/118 |
| 4,397,373 | 8/1983 | Ream | 182/63 |
| 4,459,786 | 7/1984 | Pitman | 52/118 |
| 4,589,520 | 5/1986 | Tapfer | 182/63 |
| 4,592,447 | 6/1986 | Ream | 182/127 |

*Primary Examiner*—Reinaldo P. Machado

*Attorney, Agent, or Firm*—Phillips, Moore, Lempio & Finley

[57] ABSTRACT

A pedestal scaffold type having a base member, a telescopic mast mounted vertically on the base member and a work cage mounted in cantilever manner from the upper end of the mast. The majority of the nested tubular mast sections are of rectangular cross-section and are formed of thin-walled sheet aluminum with rounded corners and vertical stiffening ribs on each side thereof extending the height thereof. Plastic slide blocks at the inner corners of the upper end and at the outer corners of the lower end of the mast section distribute the forces between the sections to relatively large areas of the aluminum sheet which forms the mast sections.

7 Claims, 6 Drawing Figures

FIGURE 6
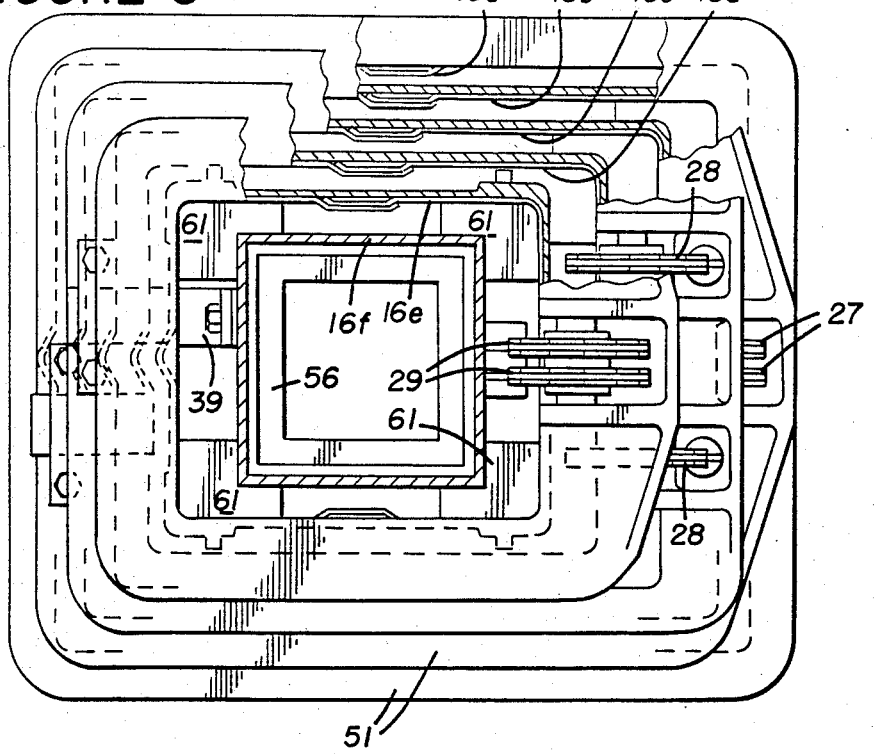
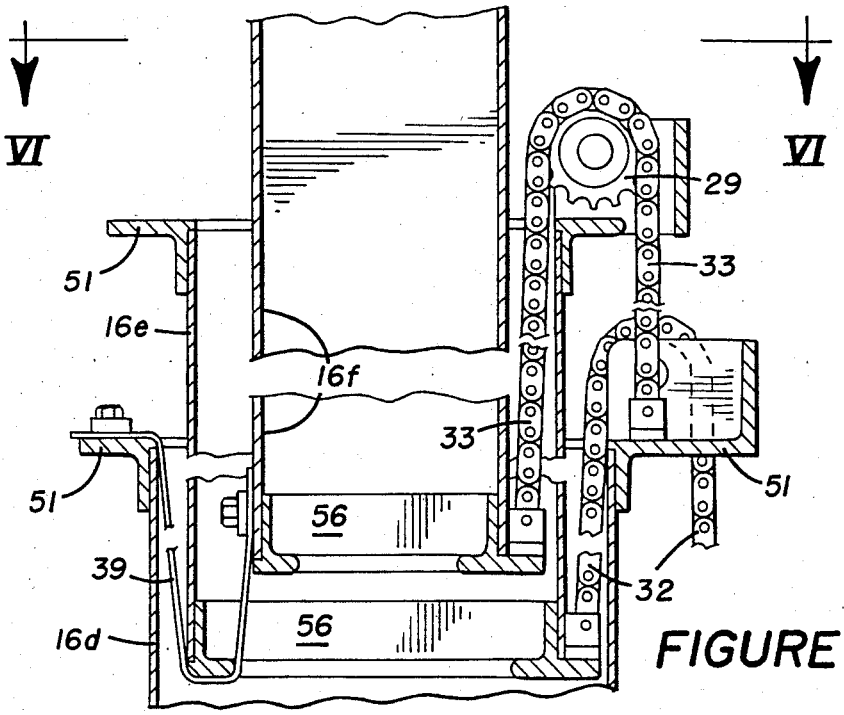
FIGURE 5

MAST CONSTRUCTION FOR PEDESTAL SCAFFOLD

TECHNICAL FIELD

This invention relates to movable pedestal type scaffold units such as shown in U.S. Pat. No. 4,397,373, issued Aug. 9, 1983, and application Ser. No. 781,221, filed Sept. 27, 1985, and now U.S. Pat. No. 4,592,447, issued June 3, 1986.

BACKGROUND ART

Personnel lifts of the pedestal type exemplified by the above patents typically have an upright mast mounted on a relatively small base member, and a work cage mounted on the mast for vertical movement.

The present invention is particularly directed to an improved construction of the vertically extendible mast of such scaffold units. For example, the mast of the U.S. Pat. No. 4,397,373 comprises a plurality of side-by-side parallel frame sections arranged to extend vertically relative to each other. Typically, these mast sections comprise opposed vertical extruded aluminum channels connected together by a plurality of cross pieces. With such construction, the mast sections are relatively heavy and relatively expensive to manufacture. The weight of a scaffold unit of this type is an important consideration since these units must be moved from place to place and loaded onto and off of trucks by the workmen using the scaffolds. The cost of construction is also an important consideration in enabling the scaffold units to be sold at a price that can be afforded by purchasers. The weight of the mast sections is, of course, also related to the cost of manufacture in that the more the weight, the more the material that is used in the mast.

The mast of the Ser. No. 781,221 application comprises a plurality of telescopically arranged aluminum extrusions. Again, such a mast is relatively heavy and expensive to manufacture. In particular, aluminum extrusions require costly dies for the extrusion process and the wall thickness of an extruded column must inherently be relatively great. The outermost mast sections in particular will have considerable weight and be quite high in manufacturing cost.

The main object of the present invention is to provide a pedestal type scaffold with a extendable mast which is much lighter in weight and more economical in manufacture than those of the prior art.

DISCLOSURE OF THE INVENTION

The present invention is directed overcoming the problems set forth above and towards fulfilling the above object.

In general, the present invention provides a pedestal scaffold having a base member, a mast mounted on the base member, and a work cage carried by the upper end of the mast, the mast including a plurality of nested tubular mast sections in which the majority of the mast sections are made of thin-walled sheet aluminum, with rounded corners and vertical stiffening ribs on each side of the section. Plastic slide blocks at the upper and lower ends of the mast sections and at the four corners of the mast sections have mast engaging surfaces complimentary in shape to the rounded corners of the mast sections.

In a further aspect of the invention, chains and straps fit into the narrow spaces between the mast sections for raising and lowering of the mast sections.

Other aspects and advantages of the invention will be set forth in the course of the following detailed description.

BRIEF DESCRIPTION OF THE DRAWINGS

In the drawings which form a part of the application, and in which like parts are designated by like reference numerals throughout the same.

FIG. 5 is a vertical sectional view through portions of the three innermost stages of the mast of FIG. 1.

FIG. 6 is a sectional view of the mast of FIG. 1.

DESCRIPTION OF THE PREFERRED EMBODIMENTS

Figures 1, 2:
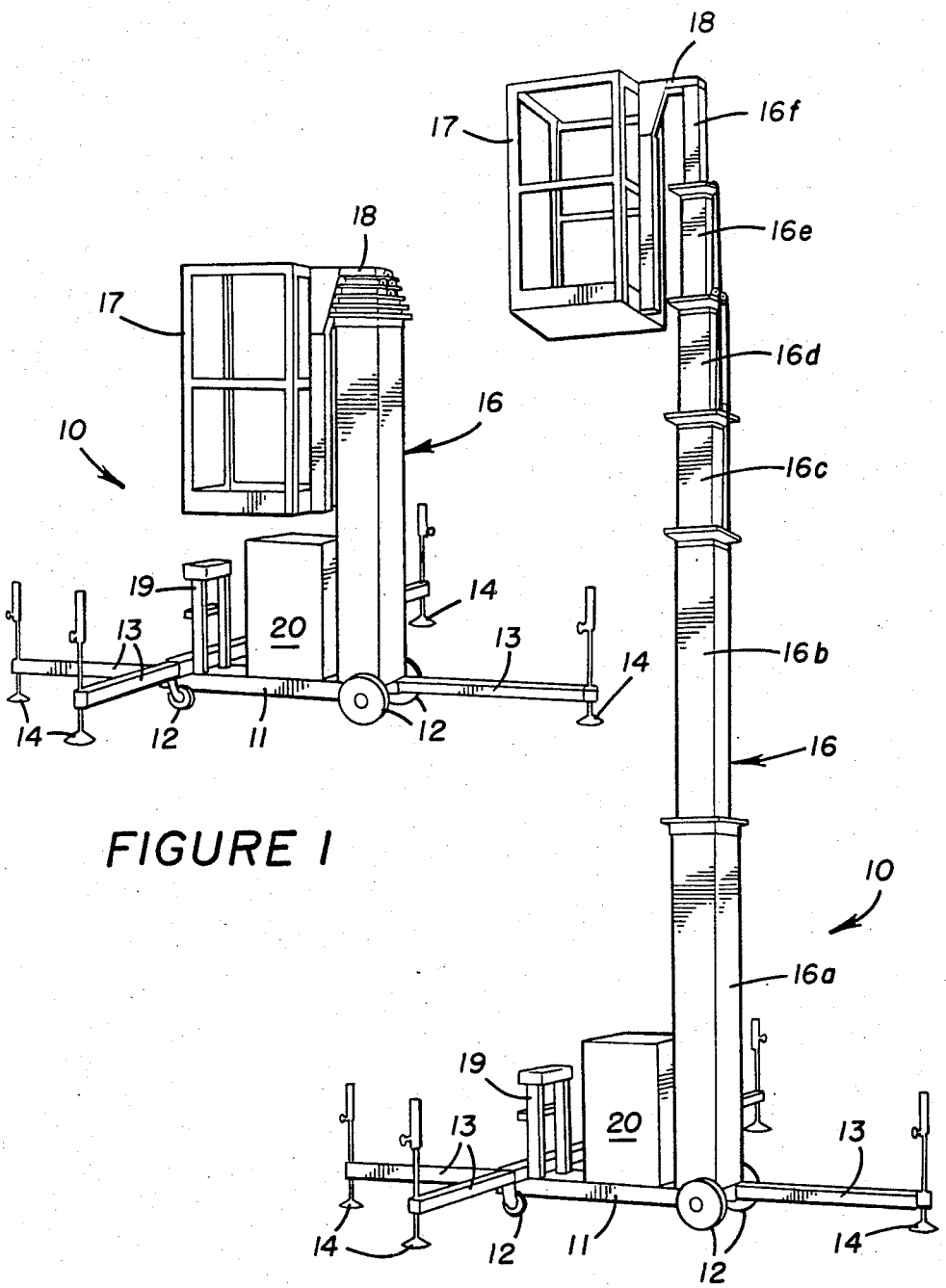
FIG. 1 is a perspective view of a personnel lift with a telescopic mast constructed in accordance with the present invention, the mast shown in retracted position.
FIG. 2 is a view as in FIG. 1 with the mast of FIG. 1 shown in an extended position.

Referring now to the drawings, wherein is illustrated a preferred embodiment of the invention, FIG. 1 shows a movable pedestal scaffold 10 having a base member 11 with wheels 12 at either end of the base member. As is conventional in these type units, outriggers 13, each with a vertically adjustable ground engaging member 14, are attachable to the base member 11 to provide an extended area of support for the unit.

At one end of the base member 11, a vertical mast 16 extends upwardly. As seen in FIG. 2, the mast 16 comprises six telescoped mast sections **16*a–f*, the outermost mast section 16*a* being mounted on the base member 11. A work cage 17 is mounted, by cantilever arm 18, to the upper end of the innermost mast section 16*f*. As shown in the drawings, the work cage is spaced horizontally from the innermost mast section 16*f* and extends downwardly from the upper end of the mast section 16*f*** and along one side of the mast.

A ladder 19 on the base member 11 enables a workman to climb up to the work cage when the cage is at its downwardly retracted position of FIG. 1. Also carried in the base member 11, as generally indicated at 20, is apparatus for powering the elevation of the telescopic mast 16 and work cage 17. Typically, such apparatus 20 will include a hydraulic reservoir, a fluid pump and batteries for driving the pump.

Figure 3:
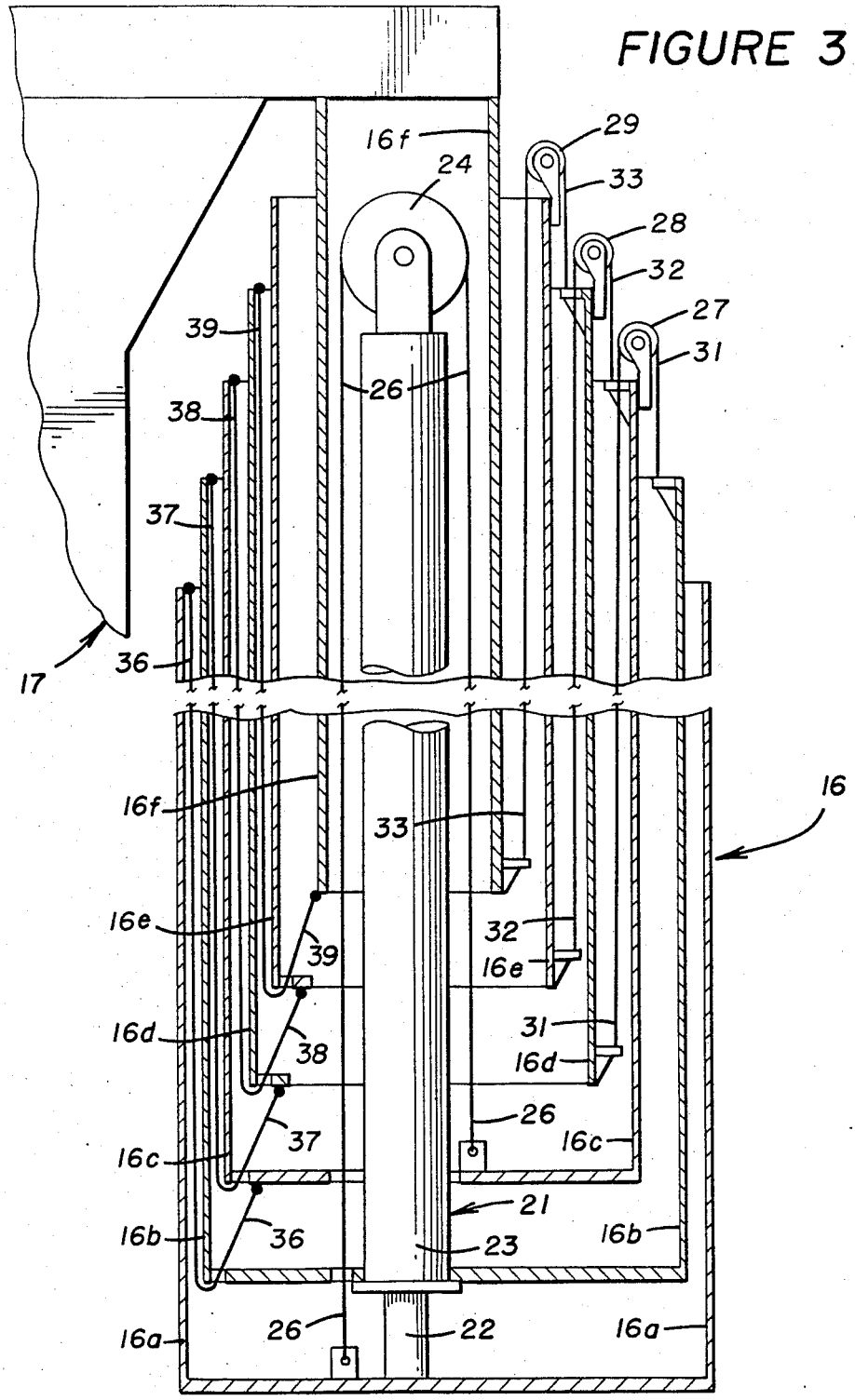
FIG. 3 is a simplified cross-sectional view of the mast of FIG. 1, showing the various stages thereof and the apparatus for extending the mast.

FIG. 3 shows in simplified form the apparatus for vertical extension of the sections **16*b–f* of mast 16. A extensible fluid-operated ram 21 is vertically disposed centrally of the mast 16, with its piston member 22 secured to the lower end of the outermost mast section 16*a* and with its cylinder member 23 secured to the lower end of the next innermost mast section 16*b*. A sprocket 24 is mounted on the upper end of ram 21 and chain 26 extends around sprocket 24 with one end of the chain 26 being connected to the lower end of the outermost mast section 16*a* and with the other end of the chain being connected to the lower end of mast section 16*c***.

Additional sprockets 27, 28 and 29 are mounted on the upper ends of mast sections **16*c*, 16*d* and 16*e*, respectively. Chain 31 extends from the upper end of mast section 16*b* up over sprocket 27 and then down to the lower end of mast section 16*d*. Likewise, chain 32 runs from the upper end of mast section 16*c* upward over sprocket 28 and down to the lower end of mast section 16*e*, while chain 33 runs from the upper end of mast section 16*d* up over sprocket 29 and down to the lower end of the innermost mast section 16*f***.

In operation, vertical extension of ram 21 will directly move mast section **16*b* upwardly from mast section 16*a*. This relative movement will in cause chain 26 to pull mast section 16*c* upwardly relative to mast section 16*b*. In turn, this relative upward movement will cause chain 31 to pull mast section 16*d* upwardly relative to mast section 16*c*. Likewise, chain 32 will pull mast section 16*e* upwardly relative to section 16*f*, and chain 33 will pull the innermost mast section 16*f* upwardly relative to section 16*e***.

The lift forces exerted by the chains on the mast sections are necessarily offset from the central axis of the mast. However, the offset forces are balanced to a considerable degree by the weight of the work cage and its occupant which are also offset from the central axis of the mast, but on the side of the mast opposite from the chain mechanism.

The chains and sprockets described above are preferably doubled for the stages to equalize loading forces and to provide backup support in the event of a chain failure.

Still with reference to FIG. 3, a plurality of fabric straps 36, 37, 38 and 39, made for example of nylon material, interconnect the mast sections on the side of the mast opposite to the chains described above, with each strap being secured to the upper end of a mast section and extending down to and around the lower end of the next innermost mast section and then being secured to the lower end of the then next innermost mast section. For example, strap 36 is secured to mast section **16*a*, extends down around the lower end of mast section 16*b* and is secured to the lower end of mast section 16*c***.

In normal operation, the mast 16 will retract downwardly with release of hydraulic fluid from the ram 21 causing mast secsection **16*b* to move downwardly. The weight of the work cage will cause the other mast sections to lower as the various sprockets 24, 27, 28 and 29 move downwardly. During such operation, the straps 36–39** merely follow the downward movement of the mast sections and bear no stress.

If however one of the mast sections should hang up during retraction then the straps 36–39 will serve to prevent retraction of lower mast sections. For example, suppose mast section **16*d* were to hang up on some obstruction as it was moving downwardly. The lower end of mast section 16*d* would then be "fixed" against further downward movement. Since the upper end of the outermost mast section 16*a* is likewise fixed against vertical movement, straps 36 and 37 will support mast sections 16*b* and 16*c* and prevent them from moving downwardly. Chains 32 and 33 will likewise prevent any downward movement of the mast sections 16*e* and 16*f* above the hung-up mast section 16*d***.

Thus, if any mast section is externally prevented from retracting downwardly, the straps and chains will prevent all of the other mast sections from retracting. The use of straps as disclosed is very advantageous since they are strong, flexible and can fit easily into the very restricted spaces between the mast sections. In case of such a hang up, the operator can then cause the mast to extend upwardly so that the obstruction can be removed. After that, retraction can take place in a normal manner.

Figure 4:
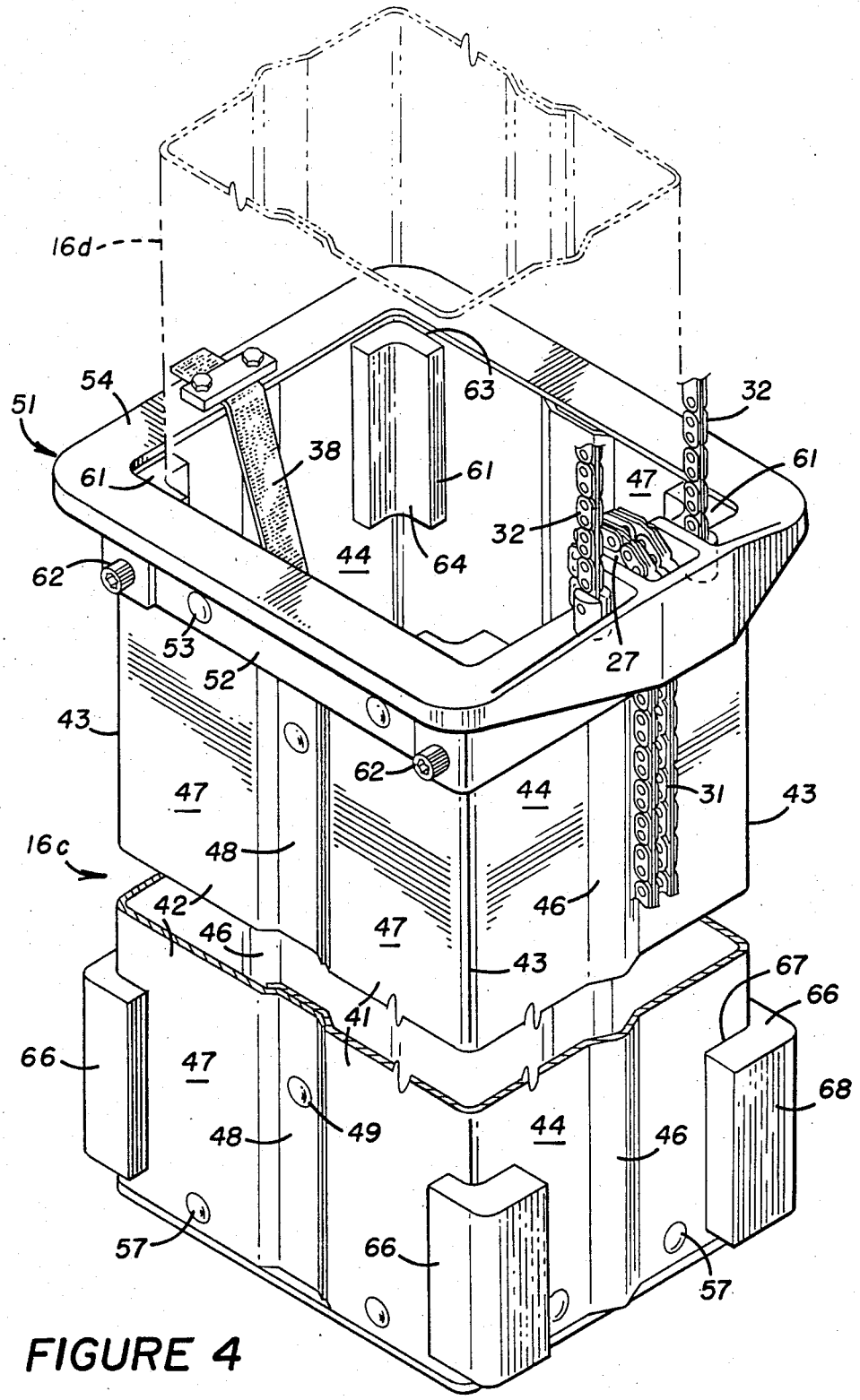
FIG. 4 is a perspective view of one of the stages of the mast of FIG. 1.

FIGS. 4–6 illustrate the details of the sections of the mast 12. FIG. 4 illustrates, in perspective, mast section **16*c*. As is shown, mast section 16*c* is made from two identical U-shaped channels 41 and 42** formed from thin-walled sheet aluminum. By way of example, personnel lifts have been built in accordance with the present invention with a 38 foot maximum platform height and using 5052 H32 sheet aluminum with a 0.060 inch wall thickness for the sheet aluminum mast sections.

Each U-shaped channel 41 and 42 is formed will substantially rounded corners 43 and is deformed from the plane of the base side 44 of the channel to provide a stiffening rib 46 extending the full height of the channel. The legs 47 of the channel are also deformed from the planes of the legs to provide offset end portions 48 parallel to the planes of the legs. The two channel sections 41 and 42 are placed with the offset portions 48 adjacent to each other and are joined together by rivets 49 along the height of the mast section. The offset portions thus form a stiffening rib.

An upper collar 51, preferably of cast aluminum, surrounds the upper end of the joined together sheet aluminum channels 41 and 42, the collar 51 having vertical flanges 52, to which the channels 41 and 42 are secured by rivets 53, and an outwardly projecting horizontal flange 54. The collar 51 protects the upper edges of the sheet aluminum channels and maintains the rectangularity of the mast section. In addition, the collar 51 supports sprocket 27 and provides a rigid member to which chains 32 are secured. Likewise, the collar 51 provides a rigid member for attachment of strap 38.

A similar, but inverted, lower collar 56, also preferably of cast aluminum, extends around the inside of the joined together sheet aluminum channels and is secured thereto by rivets 57. This collar likewise protects the lower edges of the channels 41 and 42, maintains the rectangularity of the mast section, and provides a rigid member for attachment to the strap 36 (not shown in FIG. 4) secured thereto. For other mast sections, the lower collar 51 also provides a rigid member to which chains 31, 32 and 33 may be secured.

Each of the aluminum sheet mast sections **16*b–e* has an upper and lower collar 51, 56 generally as described in connection with mast section 16*c*. The outermost mast section 16*a* has an upper collar 51 thereon, but no lower collar 56 is needed since the attachment of the mast section 16*a* to the frame member 11** serves the purpose.

The preferred embodiment shown herein has an extruded aluminum tube as the innermost mast section **16*f***. Because of the relatively small cross-sectional modulus of this innermost mast section, a thicker walled aluminum sheet would be necessary to withstand the high bending stresses. Further, the mast was designed so that the innermost mast section has a 4×4 inch size which is a standard, commercially available aluminum extrusion, with a ⅛ inch wall thickness.

For a six stage mast as illustrated herein, with a maximum platform height of 38 feet, the mast sections will range in height from about 7 feet for mast section **16*a* to about 5½ feet for the innermost mast section 16*f*. The cross-sectional area of the mast sections ranges from about 9×12 inches for mast section 16*a* to 4×4 inches for the mast section 16*f***.

With further reference to FIG. 4, the mast section 16*c* has a set of four plastic slide blocks 61 mounted on the upper end of the mast section, with one of the slide blocks being mounted at each of the four inside corners of the mast section and secured thereto, as by screws 62, the slide blocks being approximately 6 inches in height. Each slide block has an outer surface 63 of a shape complementary to the shape of the inside corner of the mast section to which it is secured and an inner surface 64 of a shape complementary to the shape of the outside corner of the next inner mast section 16*d* adjacent thereto. Preferably, the slide blocks are made of UHMW (ultra high molecular weight) high density polyethylene. The slide blocks are placed at the corners of the mast sections where the mast sections are strongest and where the least amount of deformation will occur when the mast is under load. The rounded corners of the mast sections and the complementary shaped slide blocks serve to distribute the bearing pressure on the slide blocks and to distribute the force from the slide blocks onto a relatively large area of the thin-walled aluminum sheet mast sections.

In like manner, mast section 16*c* has a set of four slide blocks 66 mounted on the lower end of the mast section at the outside of each of the four corners. Slide blocks 66 each have an inner surface 67 of a shape complementary to the shape of the outside corner of mast section 16*c* to which it is mounted and an outer surface 68 of a shape complementary to the shape of the inner corner of the next mast section adjacent thereto. Again, the shape of the slide blocks spreads the forces over a substantial area of the aluminum sheet instead of concentrating them at a sharp corner.

As may be seen from the foregoing, the present invention provides a mast that is relatively light in weight and relatively inexpensive to manufacture because it is largely made out of thin walled aluminum sheet rather than thicker and considerably more expensive aluminum extrusions. The relatively large rectangular cross-section of the mast section provides for a very efficient distribution of material while providing a very rigid mast which will resist bending forces from the cantilever mounted work cage and torsional forces impared by reaction forces by a workman working to his side while in the cage.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others in the art to best utilize the invention in various embodiments and with various modifications as are suited to the particular use contemplated. It is intended that the scope of the invention be defined by the claims appended hereto.

We claim:

1. A pedestal scaffold comprising:

(a) a base member having ground engageable supports, (b) a vertical mast mounted on said base member, said mast having a plurality of telescopically nested tubular mast sections of rectangular cross-section, the majority of which mast sections are made from thin-walled sheet aluminum with rounded corners and a vertical stiffening rib formed on each side and extending the height thereof, (c) a first set of four plastic slide blocks mounted on the upper end of each mast section except the innermost section, each of the four slide blocks in a set being mounted at a different one of the inside corners of a mast section, each slide block having an outer surface of a shape complementary to the shape of the inside corner of the mast section to which it is mounted and having an inner surface of a shape complementary to the shape of the outside corner of the next inner mast section adjacent thereto, (d) a second set of four plastic slide blocks mounted on the lower end of each mast section except the outermost section, each of the four slide blocks of a set being mounted at a different one of the outside corners of a mast section, each slide block having an inner surface of a shape complementary to the shape of the outside corner to which it is mounted and an outer surface of a shape complementary to the shape of the inner corner of the next outer mast section adjacent thereto, (e) a work cage mounted on the upper end of the innermost of said mast sections, said work cage being spaced horizontally from said innermost mast section, (f) an extensible ram vertically disposed in said mast and having a piston member and a housing member, one of which members is secured to the lower end of the outermost of said mast sections and the other of which members is secured to the lower end of the next innermost mast section, (g) extending means for upwardly extending all of said mast sections which are inwardly of the next to outermost mast sections in response to upward movement of said next to outermost mast section relative the outermost mast section, said means including a plurality of chains interconnecting said mast sections and located on the side of said mast sections opposite to said work cage.

2. A pedestal scaffold as set forth in claim 1 wherein at least one of said sheet aluminum mast sections comprises two identical U-shaped channels formed from sheet aluminum, with each leg of the channel having a parallel offset end portion, the two U-shaped channels being disposed with the offset portion adjacent to and riveted to each other.

3. A pedestal scaffold as set forth in claim 2 wherein each of said sheet aluminum mast sections inwardly of the outermost mast section and outwardly of the innermost mast section includes an upper collar around and secured to the outside of the upper end of the mast section and a lower collar around and secured to the inside of the mast section.

4. A pedestal scaffold as set forth in claim 3 wherein said extending means includes a sprocket mounted on the upper collar of one of said mast sections and a chain trained around said sprocket, said chain being secured to the upper collar of the next outermost mast section and to the lower collar of the next innermost mast section.

5. A pedestal scaffold as set forth in claim 4, and further including a plurality of fabric strap members, on the side of said mast sections opposite to said chains, each strap being secured to the upper end of a mast section and extending down to and around the lower end of the next innermost mast section and being secured to the lower end of the then next innermost mast section.

6. A pedestal scaffold as set forth in claim 4 wherein said extending means includes a sprocket mounted on the upper end of the ram member which is secured to said next innermost mast section and a chain trained around said sprocket, said chain being secured at one end to the outermost mast section and being secured at the other end to the then next innermost mast section.

7. A pedestal scaffold as set forth in claim 6, and further including a plurality of fabric strap members, on the side of said mast sections opposite to said chains, each strap being secured to the upper end of a mast section and extending down to and around the lower end of the next innermost mast section and being secured to the lower end of the then next innermost mast section.

* * * * *